US010408395B2

(12) United States Patent
Danesh

(10) Patent No.: US 10,408,395 B2
(45) **Date of Patent: *Sep. 10, 2019**

(54) RECESSED LIGHTING SYSTEMS

(71) Applicant: DMF, Inc., Carson, CA (US)

(72) Inventor: Michael D. Danesh, Carson, CA (US)

(73) Assignee: DMF, Inc., Carson, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/947,065

(22) Filed: Apr. 6, 2018

(65) Prior Publication Data

US 2018/0231197 A1 Aug. 16, 2018

Related U.S. Application Data

(63) Continuation of application No. 14/184,601, filed on Feb. 19, 2014, now Pat. No. 9,964,266.

(Continued)

(51) Int. Cl.
*F21V 15/00* (2015.01)
*F21V 17/00* (2006.01)

(Continued)

(52) U.S. Cl.
CPC ..... *F21S 8/02* (2013.01); *F21S 8/026* (2013.01); *F21V 7/041* (2013.01); *F21V 23/006* (2013.01);

(Continued)

(58) Field of Classification Search
CPC ..... F21S 8/02; F21S 8/026; F21V 23/006; F21V 7/041; F21Y 2115/10; H04R 17/00; H04R 1/24; H04R 23/02; H04R 2499/11
See application file for complete search history.

(56) References Cited

U.S. PATENT DOCUMENTS 1,471,340 A 10/1923 Knight
2,038,784 A 4/1936 Ghadiali (Continued)

FOREIGN PATENT DOCUMENTS

CA 2243934 C 6/2002
CA 2502637 A1 9/2005

(Continued)

OTHER PUBLICATIONS

Notice of Allowance dated Mar. 26, 2018 for U.S. Appl. No. 14/184,601, 10 pages.

(Continued)

*Primary Examiner* — Tsion Tumebo
(74) *Attorney, Agent, or Firm* — Smith Baluch LLP

(57) ABSTRACT

A recessed lighting system includes a casting, a light source module and one or more optic elements disposed in the casting, and a driver to power the light source module. In one example, the system also includes a junction box or a 4-10 inch recessed lighting fixture enclosure in which the casting is disposed. The system may also include a trim to cover an exposed edge of a hole in a ceiling or a wall into which the recessed lighting system is installed. The system also may include one or more connecting mechanisms to couple the trim to one or both of the junction box/enclosure and the casting. In one example, the casting includes a front end face and the one or more connecting mechanisms couple the trim to the front end face of the casting. The connecting mechanism(s) may include a twist-and-lock friction connection.

19 Claims, 3 Drawing Sheets

Related U.S. Application Data

(60) Provisional application No. 61/843,278, filed on Jul. 5, 2013.

(51) Int. Cl.

| | |
|---|---|
| ***F21S 8/02*** | (2006.01) |
| ***H04R 17/00*** | (2006.01) |
| ***H04R 23/02*** | (2006.01) |
| ***F21V 7/04*** | (2006.01) |
| ***F21V 23/00*** | (2015.01) |
| *H04R 1/24* | (2006.01) |
| *F21Y 115/10* | (2016.01) |

(52) U.S. Cl.
CPC ..... *H04R 17/00* (2013.01); *H04R 23/02* (2013.01); *F21Y 2115/10* (2016.08); *H04R 1/24* (2013.01); *H04R 2499/11* (2013.01)

(56) References Cited

U.S. PATENT DOCUMENTS

| | | | |
|---|---|---|---|
| 2,197,737 | A | 4/1940 | Appleton |
| 2,528,989 | A | 11/1950 | Ammells |
| 2,642,246 | A | 6/1953 | Larry |
| D180,844 | S | 8/1957 | Poliakoff |
| 3,023,920 | A | 3/1962 | Cook et al. |
| 3,422,261 | A | 1/1969 | McGinty |
| 3,460,299 | A | 8/1969 | Wilson |
| 3,650,046 | A | 3/1972 | Skinner |
| 3,711,053 | A | 1/1973 | Drake |
| D227,989 | S | 7/1973 | Geisel |
| 3,812,342 | A | 5/1974 | Mcnamara |
| D245,905 | S | 9/1977 | Taylor |
| 4,088,827 | A | 5/1978 | Kohaut |
| 4,176,758 | A | 12/1979 | Glick |
| 4,399,497 | A | 8/1983 | Druffel |
| 4,520,435 | A | 5/1985 | Baldwin |
| 4,601,145 | A | 7/1986 | Wilcox |
| 4,723,747 | A | 2/1988 | Karp et al. |
| 4,729,080 | A | 3/1988 | Fremont et al. |
| 4,754,377 | A | 6/1988 | Wenman |
| 4,930,054 | A | 5/1990 | Krebs |
| 5,216,203 | A | 6/1993 | Gower |
| 5,239,132 | A | 8/1993 | Bartow |
| 5,250,269 | A | 10/1993 | Langer et al. |
| 5,266,050 | A | 11/1993 | O'Neil et al. |
| 5,382,752 | A | 1/1995 | Reyhan et al. |
| 5,465,199 | A | 11/1995 | Bray et al. |
| 5,505,419 | A | 4/1996 | Gabrius |
| 5,544,870 | A | 8/1996 | Kelly et al. |
| 5,562,343 | A | 10/1996 | Chan et al. |
| 5,571,993 | A | 11/1996 | Jones et al. |
| 5,580,158 | A | 12/1996 | Aubrey et al. |
| 5,588,737 | A | 12/1996 | Kusmer |
| 5,603,424 | A | 2/1997 | Bordwell et al. |
| 5,613,338 | A | 3/1997 | Esposito |
| D381,111 | S | 7/1997 | Lecluze |
| 5,662,413 | A | 9/1997 | Akiyama et al. |
| D386,277 | S | 11/1997 | Lecluze |
| D387,466 | S | 12/1997 | Lecluze |
| 5,738,436 | A | 4/1998 | Cummings et al. |
| 5,836,678 | A | 11/1998 | Wright et al. |
| 5,942,726 | A | 8/1999 | Reiker |
| 5,944,412 | A | 9/1999 | Janos et al. |
| 5,975,323 | A | 11/1999 | Turan |
| 6,082,878 | A | 7/2000 | Doubek et al. |
| 6,105,334 | A | 8/2000 | Monson et al. |
| 6,161,910 | A | 12/2000 | Reisenauer et al. |
| 6,170,685 | B1 | 1/2001 | Currier |
| 6,174,076 | B1 | 1/2001 | Petrakis et al. |
| 6,176,599 | B1 | 1/2001 | Farzen |
| 6,267,491 | B1 | 7/2001 | Parrigin |
| 6,332,597 | B1 | 12/2001 | Korcz et al. |
| 6,350,043 | B1 | 2/2002 | Gloisten |
| 6,364,511 | B1 | 4/2002 | Cohen |
| 6,402,112 | B1 | 6/2002 | Thomas et al. |
| D461,455 | S | 8/2002 | Forbes |
| 6,461,016 | B1 | 10/2002 | Jamison et al. |
| 6,474,846 | B1 | 11/2002 | Kelmelis et al. |
| 6,491,413 | B1 | 12/2002 | Benesohn |
| D468,697 | S | 1/2003 | Straub, Jr. |
| 6,515,313 | B1 | 2/2003 | Ibbetson et al. |
| 6,583,573 | B2 | 6/2003 | Bierman |
| 6,585,389 | B2 | 7/2003 | Bonazzi |
| 6,600,175 | B1 | 7/2003 | Baretz et al. |
| D478,872 | S | 8/2003 | Heggem |
| 6,657,236 | B1 | 12/2003 | Thibeault et al. |
| 6,666,419 | B1 | 12/2003 | Vrame |
| D488,583 | S | 4/2004 | Benghozi |
| 6,719,438 | B2 | 4/2004 | Sevack et al. |
| 6,758,578 | B1 | 7/2004 | Chou |
| 6,777,615 | B1 | 8/2004 | Gretz |
| 6,827,229 | B2 | 12/2004 | Dinh et al. |
| 6,906,352 | B2 | 6/2005 | Edmond et al. |
| D509,314 | S | 9/2005 | Rashidi |
| 6,948,829 | B2 | 9/2005 | Verdes et al. |
| 6,958,497 | B2 | 10/2005 | Emerson et al. |
| 6,964,501 | B2 | 11/2005 | Ryan |
| D516,235 | S | 2/2006 | Rashidi |
| 7,064,269 | B2 | 6/2006 | Smith |
| D528,673 | S | 9/2006 | Maxik et al. |
| D531,740 | S | 11/2006 | Maxik |
| D532,532 | S | 11/2006 | Maxik |
| 7,148,420 | B1 | 12/2006 | Johnson et al. |
| 7,154,040 | B1 | 12/2006 | Tompkins |
| 7,170,015 | B1 | 1/2007 | Roesch et al. |
| D536,349 | S | 2/2007 | Humber et al. |
| D537,039 | S | 2/2007 | Pincek |
| D539,229 | S | 3/2007 | Murphey |
| 7,186,008 | B2 | 3/2007 | Patti |
| 7,190,126 | B1 | 3/2007 | Paton |
| 7,211,833 | B2 | 5/2007 | Slater, Jr. et al. |
| 7,213,940 | B1 | 5/2007 | Van De Ven et al. |
| D547,889 | S | 7/2007 | Huang |
| D552,969 | S | 10/2007 | Bobrowski et al. |
| D553,267 | S | 10/2007 | Yuen |
| D555,106 | S | 11/2007 | Pape et al. |
| D556,144 | S | 11/2007 | Dinh |
| 7,297,870 | B1 | 11/2007 | Sartini |
| 7,312,474 | B2 | 12/2007 | Emerson et al. |
| 7,320,536 | B2 | 1/2008 | Petrakis et al. |
| D561,372 | S | 2/2008 | Yan |
| D561,373 | S | 2/2008 | Yan |
| 7,335,920 | B2 | 2/2008 | Denbaars et al. |
| D563,896 | S | 3/2008 | Greenslate |
| 7,347,580 | B2 | 3/2008 | Blackman et al. |
| D570,012 | S | 5/2008 | Huang |
| 7,374,308 | B2 | 5/2008 | Sevack et al. |
| D570,504 | S | 6/2008 | Maxik et al. |
| D570,505 | S | 6/2008 | Maxik et al. |
| 7,399,104 | B2 | 7/2008 | Rappaport |
| D578,677 | S | 10/2008 | Huang |
| 7,431,482 | B1 | 10/2008 | Morgan et al. |
| 7,432,440 | B2 | 10/2008 | Hull et al. |
| 7,442,883 | B2 | 10/2008 | Jolly et al. |
| 7,446,345 | B2 | 11/2008 | Emerson et al. |
| 7,473,005 | B2 | 1/2009 | O'Brien |
| 7,488,097 | B2 | 2/2009 | Reisenauer et al. |
| 7,503,145 | B2 | 3/2009 | Newbold et al. |
| 7,524,089 | B2 | 4/2009 | Park |
| D591,894 | S | 5/2009 | Flank |
| 7,534,989 | B2 | 5/2009 | Suehara et al. |
| D596,154 | S | 7/2009 | Rivkin |
| 7,566,154 | B2 | 7/2009 | Gloisten et al. |
| D599,040 | S | 8/2009 | Alexander et al. |
| D600,836 | S | 9/2009 | Hanley et al. |
| 7,588,359 | B2 | 9/2009 | Coushaine et al. |
| 7,592,583 | B2 | 9/2009 | Page et al. |
| D606,696 | S | 12/2009 | Chen et al. |
| 7,625,105 | B1 | 12/2009 | Johnson |
| 7,628,513 | B2 | 12/2009 | Chiu |
| 7,651,238 | B2 | 1/2010 | O'Brien |
| 7,654,705 | B2 | 2/2010 | Czech et al. |
| D611,650 | S | 3/2010 | Broekhoff |

(56) References Cited

U.S. PATENT DOCUMENTS 7,670,021 B2 3/2010 Chou
7,673,841 B2 3/2010 Wronski
7,677,766 B2 3/2010 Boyer
7,692,182 B2 4/2010 Bergmann et al.
7,704,763 B2 4/2010 Fujii et al.
D616,118 S 5/2010 Thomas et al.
7,722,208 B1 5/2010 Dupre et al.
7,722,227 B2 5/2010 Zhang et al.
7,735,795 B2 6/2010 Wronski
7,735,798 B2 6/2010 Kojima
7,748,887 B2 7/2010 Zampini, II et al.
7,766,518 B2 8/2010 Piepgras et al.
7,769,192 B2 8/2010 Takagi et al.
7,771,082 B2 8/2010 Peng
7,771,094 B2 8/2010 Goode
D624,692 S 9/2010 Mackin et al.
D625,847 S 10/2010 Maglica
D625,876 S 10/2010 Chen et al.
D627,727 S 11/2010 Alexander et al.
7,828,465 B2 11/2010 Roberge et al.
D629,366 S 12/2010 Ericson et al.
7,871,184 B2 1/2011 Peng
7,874,539 B2 1/2011 Wright et al.
7,874,709 B1 1/2011 Beadle
D633,224 S 2/2011 Lee
D636,903 S 4/2011 Torenbeek
D637,339 S 5/2011 Hasan et al.
D637,340 S 5/2011 Hasan et al.
7,950,832 B2 5/2011 Tanaka et al.
D639,499 S 6/2011 Choi et al.
D640,819 S 6/2011 Pan
7,959,332 B2 6/2011 Tickner et al.
7,967,480 B2 6/2011 Pickard et al.
D642,317 S 7/2011 Rashidi
7,972,035 B2 7/2011 Boyer
7,972,043 B2 7/2011 Schutte
D642,536 S 8/2011 Robinson
D643,970 S 8/2011 Kim et al.
D646,011 S 9/2011 Rashidi
8,013,243 B2 9/2011 Korcz et al.
8,038,113 B2 10/2011 Fryzek et al.
D648,476 S 11/2011 Choi et al.
D648,477 S 11/2011 Kim et al.
D650,115 S 12/2011 Kim et al.
8,070,328 B1 12/2011 Knoble et al.
8,096,670 B2 1/2012 Trott
D654,205 S 2/2012 Rashidi
D656,263 S 3/2012 Ogawa et al.
8,142,057 B2 3/2012 Roos et al.
8,152,334 B2 4/2012 Krogman
D658,788 S 5/2012 Dudik et al.
D658,802 S 5/2012 Chen
D659,862 S 5/2012 Tsai
D659,879 S 5/2012 Rashidi
D660,814 S 5/2012 Wilson
8,182,116 B2 5/2012 Zhang et al.
8,201,968 B2 6/2012 Maxik et al.
D663,058 S 7/2012 Pan
D663,466 S 7/2012 Rashidi
D664,274 S 7/2012 de Visser et al.
D664,705 S 7/2012 Kong et al.
8,215,805 B2 7/2012 Cogliano et al.
8,220,970 B1 7/2012 Khazi et al.
8,226,270 B2 7/2012 Yamamoto et al.
8,240,630 B2 8/2012 Wronski
D667,155 S 9/2012 Rashidi
8,262,255 B1 9/2012 Rashidi
D668,372 S 10/2012 Renshaw et al.
D668,809 S 10/2012 Rashidi
D669,198 S 10/2012 Qui
D669,199 S 10/2012 Chuang
D669,620 S 10/2012 Rashidi
8,277,090 B2 10/2012 Fryzek et al.
8,308,322 B2 11/2012 Santiago et al.
D673,869 S 1/2013 Yu
D676,263 S 2/2013 Birke
D676,814 S 2/2013 Paul
8,376,593 B2 2/2013 Bazydola et al.
D677,417 S 3/2013 Rashidi
D677,634 S 3/2013 Korcz et al.
D679,047 S 3/2013 Tickner et al.
8,403,533 B1 3/2013 Paulsel
8,403,541 B1 3/2013 Rashidi
D681,259 S 4/2013 Kong
8,408,759 B1 4/2013 Rashidi
D682,459 S 5/2013 Gordin et al.
D683,063 S 5/2013 Lopez et al.
D683,890 S 6/2013 Lopez et al.
D684,269 S 6/2013 Wang et al.
D684,719 S 6/2013 Rashidi
D685,118 S 6/2013 Rashidi
D685,120 S 6/2013 Rashidi
8,454,204 B1 * 6/2013 Chang ..... F21V 29/004
362/257
D685,507 S 7/2013 Sun
D687,586 S 8/2013 Rashidi
D687,587 S 8/2013 Rashidi
D687,588 S 8/2013 Rashidi
D687,980 S 8/2013 Gravely et al.
D688,405 S 8/2013 Kim et al.
D690,049 S 9/2013 Rashidi
D690,864 S 10/2013 Rashidi
D690,865 S 10/2013 Rashidi
D690,866 S 10/2013 Rashidi
D691,314 S 10/2013 Rashidi
D691,315 S 10/2013 Samson
D691,763 S 10/2013 Hand et al.
8,550,669 B2 10/2013 Macwan et al.
D693,043 S 11/2013 Schmalfuss et al.
D693,517 S 11/2013 Davis
D694,456 S 11/2013 Rowlette, Jr. et al.
8,573,816 B2 11/2013 Negley et al.
D695,441 S 12/2013 Lui et al.
D696,446 S 12/2013 Huh
D696,447 S 12/2013 Huh
D696,448 S 12/2013 Huh
8,602,601 B2 12/2013 Khazi et al.
D698,067 S 1/2014 Rashidi
D698,068 S 1/2014 Rashidi
8,622,361 B2 1/2014 Wronski
D698,985 S 2/2014 Lopez et al.
D699,384 S 2/2014 Rashidi
D699,687 S 2/2014 Baldwin et al.
D700,387 S 2/2014 Snell
8,641,243 B1 2/2014 Rashidi
8,659,034 B2 2/2014 Baretz et al.
D701,175 S 3/2014 Baldwin et al.
D701,466 S 3/2014 Clifford et al.
8,672,518 B2 3/2014 Boomgaarden et al.
D702,867 S 4/2014 Kim et al.
D703,843 S 4/2014 Cheng
8,684,569 B2 4/2014 Pickard et al.
D705,472 S 5/2014 Huh
8,727,582 B2 5/2014 Brown et al.
D708,381 S 7/2014 Rashidi
8,777,449 B2 7/2014 Ven et al.
D710,529 S 8/2014 Lopez et al.
8,801,217 B2 8/2014 Oehle et al.
8,820,985 B1 9/2014 Tam et al.
8,833,013 B2 9/2014 Harman
D714,989 S 10/2014 Rowlette, Jr. et al.
8,870,426 B2 10/2014 Biebl et al.
8,890,414 B2 11/2014 Rowlette, Jr. et al.
D721,845 S 1/2015 Lui et al.
8,939,418 B2 1/2015 Green et al.
D722,296 S 2/2015 Taylor
D722,977 S 2/2015 Hagarty
D722,978 S 2/2015 Hagarty
8,950,898 B2 2/2015 Catalano
D726,363 S 4/2015 Danesh
D726,949 S 4/2015 Redfern
9,004,435 B2 4/2015 Wronski
9,039,254 B2 5/2015 Danesh
D731,689 S 6/2015 Bernard et al.

(56) References Cited

U.S. PATENT DOCUMENTS

| | | | |
|---|---|---|---|
| 9,062,866 | B1 | 6/2015 | Christ et al. |
| 9,065,264 | B2 | 6/2015 | Cooper et al. |
| 9,068,719 | B2 | 6/2015 | Van De Ven et al. |
| D734,525 | S | 7/2015 | Gordin et al. |
| D735,012 | S | 7/2015 | Cowie |
| D735,142 | S | 7/2015 | Hagarty |
| 9,078,299 | B2 | 7/2015 | Ashdown |
| D739,590 | S | 9/2015 | Redfern |
| 9,140,441 | B2 | 9/2015 | Goelz et al. |
| D742,325 | S | 10/2015 | Leung |
| 9,151,457 | B2 | 10/2015 | Pickard et al. |
| 9,151,477 | B2 * | 10/2015 | Pickard ..... F21V 21/088 |
| 9,217,560 | B2 | 12/2015 | Harbers et al. |
| 9,222,661 | B2 | 12/2015 | Kim et al. |
| 9,239,131 | B1 | 1/2016 | Wronski et al. |
| 9,285,103 | B2 | 3/2016 | Van De Ven et al. |
| 9,291,319 | B2 | 3/2016 | Kathawate et al. |
| 9,301,362 | B2 | 3/2016 | Dohn et al. |
| D754,078 | S | 4/2016 | Baldwin et al. |
| D754,079 | S | 4/2016 | Baldwin et al. |
| D754,605 | S | 4/2016 | McMillan |
| 9,303,812 | B2 | 4/2016 | Green et al. |
| 9,310,038 | B2 | 4/2016 | Athalye |
| 9,322,543 | B2 | 4/2016 | Russell et al. |
| 9,347,655 | B2 | 5/2016 | Boomgaarden et al. |
| 9,366,418 | B2 | 6/2016 | Gifford |
| 9,371,966 | B2 | 6/2016 | Rowlette, Jr. et al. |
| D762,181 | S | 7/2016 | Lin |
| 9,395,051 | B2 | 7/2016 | Russell et al. |
| D762,906 | S | 8/2016 | Jeswani et al. |
| D764,079 | S | 8/2016 | Wu |
| 9,417,506 | B1 | 8/2016 | Tirosh |
| D766,185 | S | 9/2016 | Hagarty |
| D767,199 | S | 9/2016 | Wronski et al. |
| 9,447,917 | B1 | 9/2016 | Wronski et al. |
| D768,325 | S | 10/2016 | Xu |
| D768,326 | S | 10/2016 | Guzzini |
| D769,501 | S | 10/2016 | Jeswani et al. |
| D770,065 | S | 10/2016 | Tittle |
| 9,476,552 | B2 | 10/2016 | Myers et al. |
| D776,324 | S | 1/2017 | Gierl et al. |
| D777,967 | S | 1/2017 | Redfern |
| 9,534,751 | B2 | 1/2017 | Maglica et al. |
| D778,241 | S | 2/2017 | Holbrook et al. |
| D778,484 | S | 2/2017 | Guzzini |
| D779,100 | S | 2/2017 | Redfern |
| 9,581,302 | B2 | 2/2017 | Danesh |
| 9,599,315 | B1 | 3/2017 | Harpenau et al. |
| 9,605,910 | B2 | 3/2017 | Swedberg et al. |
| D785,228 | S | 4/2017 | Guzzini |
| D786,472 | S | 5/2017 | Redfern |
| D786,474 | S | 5/2017 | Fujisawa |
| D788,330 | S | 5/2017 | Johnson et al. |
| D790,102 | S | 6/2017 | Guzzini |
| 9,673,597 | B2 | 6/2017 | Lee |
| 9,689,541 | B2 | 6/2017 | Wronski |
| D791,709 | S | 7/2017 | Holton |
| D791,711 | S | 7/2017 | Holton |
| D791,712 | S | 7/2017 | Holton |
| 9,696,021 | B2 | 7/2017 | Wronski |
| 9,702,516 | B1 | 7/2017 | Vasquez et al. |
| D795,820 | S | 8/2017 | Wengreen |
| 9,732,904 | B1 | 8/2017 | Wronski |
| 9,739,464 | B2 | 8/2017 | Wronski |
| 9,791,111 | B1 | 10/2017 | Huang et al. |
| 9,803,839 | B2 | 10/2017 | Visser et al. |
| D805,660 | S | 12/2017 | Creasman et al. |
| D809,176 | S | 1/2018 | Partington |
| 9,863,619 | B2 | 1/2018 | Mak |
| D809,465 | S | 2/2018 | Keirstead |
| 9,964,266 | B2 | 5/2018 | Danesh |
| D820,494 | S | 6/2018 | Cohen |
| 9,995,441 | B2 | 6/2018 | Power et al. |
| D824,494 | S | 7/2018 | Martins et al. |
| D832,218 | S | 10/2018 | Wronski et al. |
| D833,977 | S | 11/2018 | Danesh et al. |
| 10,139,059 | B2 | 11/2018 | Danesh |
| D836,976 | S | 1/2019 | Reese et al. |
| D848,375 | S | 5/2019 | Danesh et al. |
| D851,046 | S | 6/2019 | Peng et al. |
| 2002/0172047 | A1 | 11/2002 | Ashley |
| 2003/0006353 | A1 | 1/2003 | Dinh et al. |
| 2003/0021104 | A1 | 1/2003 | Tsao |
| 2003/0161153 | A1 | 8/2003 | Patti |
| 2004/0001337 | A1 | 1/2004 | Defouw et al. |
| 2005/0225966 | A1 | 10/2005 | Hartmann et al. |
| 2005/0227536 | A1 | 10/2005 | Gamache et al. |
| 2005/0231962 | A1 | 10/2005 | Koba et al. |
| 2005/0237746 | A1 | 10/2005 | Yiu |
| 2006/0005988 | A1 | 1/2006 | Jorgensen |
| 2006/0158873 | A1 | 7/2006 | Newbold et al. |
| 2006/0198126 | A1 | 9/2006 | Jones |
| 2006/0215408 | A1 | 9/2006 | Lee |
| 2006/0237601 | A1 | 10/2006 | Rinderer |
| 2006/0243877 | A1 | 11/2006 | Rippel |
| 2006/0250788 | A1 | 11/2006 | Hodge et al. |
| 2007/0035951 | A1 | 2/2007 | Tseng |
| 2007/0185675 | A1 | 8/2007 | Papamichael et al. |
| 2007/0200039 | A1 | 8/2007 | Petak |
| 2007/0206374 | A1 | 9/2007 | Petrakis et al. |
| 2008/0002414 | A1 | 1/2008 | Miletich et al. |
| 2008/0112168 | A1 | 5/2008 | Pickard et al. |
| 2008/0112170 | A1 | 5/2008 | Trott |
| 2008/0112171 | A1 | 5/2008 | Patti et al. |
| 2008/0137347 | A1 | 6/2008 | Trott et al. |
| 2008/0165545 | A1 | 7/2008 | O'Brien |
| 2008/0232116 | A1 | 9/2008 | Kim |
| 2008/0247181 | A1 | 10/2008 | Dixon |
| 2009/0003009 | A1 | 1/2009 | Tessnow et al. |
| 2009/0034261 | A1 | 2/2009 | Grove |
| 2009/0080189 | A1 | 3/2009 | Wegner |
| 2009/0086484 | A1 | 4/2009 | Johnson |
| 2009/0135613 | A1 | 5/2009 | Peng |
| 2009/0141500 | A1 | 6/2009 | Peng |
| 2009/0141506 | A1 | 6/2009 | Lan et al. |
| 2009/0141508 | A1 | 6/2009 | Peng |
| 2009/0147517 | A1 | 6/2009 | Li |
| 2009/0161356 | A1 | 6/2009 | Negley et al. |
| 2009/0237924 | A1 | 9/2009 | Ladewig |
| 2009/0280695 | A1 | 11/2009 | Sekela et al. |
| 2009/0283292 | A1 | 11/2009 | Lehr |
| 2009/0290343 | A1 | 11/2009 | Brown et al. |
| 2010/0014282 | A1 | 1/2010 | Danesh |
| 2010/0061108 | A1 | 3/2010 | Zhang et al. |
| 2010/0110690 | A1 | 5/2010 | Hsu et al. |
| 2010/0110698 | A1 | 5/2010 | Harwood et al. |
| 2010/0148673 | A1 | 6/2010 | Stewart et al. |
| 2010/0149822 | A1 | 6/2010 | Cogliano et al. |
| 2010/0165643 | A1 | 7/2010 | Russo et al. |
| 2010/0244709 | A1 | 9/2010 | Steiner et al. |
| 2010/0246172 | A1 | 9/2010 | Liu |
| 2010/0259919 | A1 | 10/2010 | Khazi et al. |
| 2010/0270903 | A1 | 10/2010 | Jao et al. |
| 2010/0284185 | A1 | 11/2010 | Ngai |
| 2010/0302778 | A1 | 12/2010 | Dabiet et al. |
| 2011/0043040 | A1 | 2/2011 | Porter et al. |
| 2011/0063831 | A1 | 3/2011 | Cook |
| 2011/0068687 | A1 | 3/2011 | Takahasi et al. |
| 2011/0069499 | A1 | 3/2011 | Trott et al. |
| 2011/0080750 | A1 | 4/2011 | Jones et al. |
| 2011/0116276 | A1 | 5/2011 | Okamura et al. |
| 2011/0134634 | A1 | 6/2011 | Gingrich, III et al. |
| 2011/0134651 | A1 | 6/2011 | Berman |
| 2011/0140633 | A1 | 6/2011 | Archenhold |
| 2011/0170294 | A1 | 7/2011 | Mier-Langner et al. |
| 2011/0194299 | A1 | 8/2011 | Crooks et al. |
| 2011/0216534 | A1 | 9/2011 | Tickner et al. |
| 2011/0226919 | A1 | 9/2011 | Fryzek et al. |
| 2011/0241557 | A1 | 10/2011 | Grotkowski et al. |
| 2011/0255292 | A1 | 10/2011 | Shen |
| 2011/0267828 | A1 | 11/2011 | Bazydola et al. |
| 2011/0285314 | A1 | 11/2011 | Carney et al. |
| 2012/0020104 | A1 | 1/2012 | Biebl et al. |
| 2012/0074852 | A1 | 3/2012 | Delnoij |

(56) References Cited

U.S. PATENT DOCUMENTS

| | | | | |
|---|---|---|---|---|
| 2012/0106176 | A1 | 5/2012 | Lopez et al. | |
| 2012/0113642 | A1* | 5/2012 | Catalano | F21S 8/02 362/249.02 |
| 2012/0140442 | A1 | 6/2012 | Woo et al. | |
| 2012/0162994 | A1 | 6/2012 | Wasniewski et al. | |
| 2012/0182744 | A1 | 7/2012 | Santiago et al. | |
| 2012/0188762 | A1 | 7/2012 | Joung et al. | |
| 2012/0243237 | A1* | 9/2012 | Toda | F21V 23/006 362/306 |
| 2012/0287625 | A1* | 11/2012 | Macwan | F21S 8/026 362/235 |
| 2012/0305868 | A1 | 12/2012 | Callahan et al. | |
| 2013/0009552 | A1 | 1/2013 | Page | |
| 2013/0010476 | A1 | 1/2013 | Pickard et al. | |
| 2013/0016864 | A1 | 1/2013 | Ivey et al. | |
| 2013/0033872 | A1* | 2/2013 | Randolph | F21V 29/004 362/294 |
| 2013/0051012 | A1* | 2/2013 | Oehle | F21S 8/026 362/235 |
| 2013/0141913 | A1 | 6/2013 | Sachsenweger | |
| 2013/0163254 | A1 | 6/2013 | Chang et al. | |
| 2013/0170232 | A1 | 7/2013 | Park et al. | |
| 2013/0170233 | A1 | 7/2013 | Nezu et al. | |
| 2013/0258677 | A1 | 10/2013 | Fryzek et al. | |
| 2013/0265750 | A1* | 10/2013 | Pickard | F21V 21/088 362/184 |
| 2013/0271989 | A1 | 10/2013 | Hussell et al. | |
| 2013/0294084 | A1 | 11/2013 | Kathawate et al. | |
| 2013/0301252 | A1 | 11/2013 | Hussell et al. | |
| 2013/0322062 | A1 | 12/2013 | Danesh | |
| 2013/0322084 | A1 | 12/2013 | Ebisawa | |
| 2013/0335980 | A1 | 12/2013 | Nakasuji et al. | |
| 2014/0036497 | A1 | 2/2014 | Hussell et al. | |
| 2014/0049957 | A1 | 2/2014 | Goelz et al. | |
| 2014/0063776 | A1 | 3/2014 | Clark et al. | |
| 2014/0071679 | A1* | 3/2014 | Booth | F21V 29/2212 362/249.02 |
| 2014/0071687 | A1 | 3/2014 | Tickner et al. | |
| 2014/0140490 | A1 | 5/2014 | Roberts et al. | |
| 2014/0063818 | A1 | 6/2014 | Randolph et al. | |
| 2014/0159616 | A1 | 6/2014 | Wang et al. | |
| 2014/0233246 | A1 | 8/2014 | Lafreniere et al. | |
| 2014/0254177 | A1 | 9/2014 | Danesh | |
| 2014/0265933 | A1 | 9/2014 | Melanson et al. | |
| 2014/0268836 | A1 | 9/2014 | Thompson | |
| 2014/0299730 | A1 | 10/2014 | Green et al. | |
| 2014/0321122 | A1 | 10/2014 | Domagala et al. | |
| 2014/0347848 | A1 | 11/2014 | Pisavadia et al. | |
| 2015/0009676 | A1 | 1/2015 | Danesh | |
| 2015/0029732 | A1 | 1/2015 | Hatch | |
| 2015/0138779 | A1 | 5/2015 | Livesay et al. | |
| 2015/0184837 | A1 | 7/2015 | Zhang et al. | |
| 2015/0198324 | A1 | 7/2015 | O'Brien et al. | |
| 2015/0219317 | A1 | 8/2015 | Gatof et al. | |
| 2015/0233556 | A1 | 8/2015 | Danesh | |
| 2015/0241039 | A1 | 8/2015 | Fryzek | |
| 2015/0263497 | A1 | 9/2015 | Korcz et al. | |
| 2015/0276185 | A1 | 10/2015 | Bailey et al. | |
| 2015/0308662 | A1 | 10/2015 | Vice et al. | |
| 2015/0345761 | A1 | 12/2015 | Lawlor | |
| 2015/0362159 | A1 | 12/2015 | Ludyjan | |
| 2016/0126860 | A1 | 5/2016 | Summerland | |
| 2016/0209007 | A1 | 7/2016 | Belmonte et al. | |
| 2016/0218626 | A1 | 7/2016 | Del Carmen | |
| 2016/0308342 | A1 | 10/2016 | Witherbee et al. | |
| 2016/0312987 | A1 | 10/2016 | Danesh | |
| 2016/0348860 | A1 | 12/2016 | Danesh | |
| 2016/0348861 | A1 | 12/2016 | Bailey et al. | |
| 2016/0366738 | A1 | 12/2016 | Boulanger et al. | |
| 2017/0045213 | A1 | 2/2017 | Williams et al. | |
| 2017/0059135 | A1 | 3/2017 | Jones | |
| 2017/0138576 | A1 | 5/2017 | Peng et al. | |
| 2017/0138581 | A1 | 5/2017 | Doust | |
| 2017/0307188 | A1 | 10/2017 | Oudina et al. | |
| 2018/0372284 | A1 | 12/2018 | Danesh et al. | |
| 2019/0049080 | A1 | 2/2019 | Danesh | |
| 2019/0063701 | A1 | 2/2019 | Lotfi et al. | |
| 2019/0093836 | A1 | 3/2019 | Danesh | |

FOREIGN PATENT DOCUMENTS

| | | | |
|---|---|---|---|
| CA | 2691480 | C | 4/2012 |
| CA | 2734369 | A1 | 10/2013 |
| CA | 2561459 | A1 | 11/2013 |
| CA | 2815067 | | 11/2013 |
| CA | 2848289 | A1 | 10/2014 |
| CN | 2182475 | Y | 11/1994 |
| CN | 201059503 | Y | 5/2008 |
| CN | 201259125 | Y | 6/2009 |
| CN | 101608781 | A | 12/2009 |
| CN | 201636626 | U | 11/2010 |
| CN | 102062373 | A | 5/2011 |
| CN | 202014067 | U | 10/2011 |
| CN | 202392473 | U | 11/2011 |
| CN | 103307518 | A | 3/2012 |
| CN | 202733693 | U | 2/2013 |
| CN | 103322476 | A | 9/2013 |
| CN | 203215483 | U | 9/2013 |
| CN | 20327663 | U | 11/2013 |
| CN | 101498411 | B | 11/2013 |
| CN | 104654142 | A | 11/2013 |
| CN | 203297980 | U | 11/2013 |
| CN | 103712135 | B | 12/2013 |
| CN | 203628464 | U | 12/2013 |
| CN | 203641919 | U | 6/2014 |
| CN | 204300818 | U | 4/2015 |
| CN | 204513161 | U | 7/2015 |
| CN | 204611541 | U | 9/2015 |
| CN | 204786225 | U | 11/2015 |
| CN | 204829578 | U | 12/2015 |
| CN | 205606362 | U | 9/2016 |
| CN | 2016130742 | U | 4/2017 |
| CN | 103154606 | B | 5/2017 |
| CN | 206222112 | U | 6/2017 |
| CN | 107013845 | A | 8/2017 |
| CN | 107084343 | A | 8/2017 |
| DE | 9109828 | U1 | 2/1992 |
| DE | 199 47 208 | | 5/2001 |
| EP | 1 672 155 | A1 | 6/2006 |
| EP | 2 095 938 | A1 | 2/2008 |
| EP | 2 306 072 | A1 | 4/2011 |
| EP | 2 453 169 | A2 | 5/2012 |
| EP | 2 193 309 | B1 | 7/2012 |
| EP | 2 735 787 | A1 | 5/2014 |
| EP | 3 104 024 | A1 | 12/2016 |
| GB | 2427020 | A | 12/2006 |
| GB | 2509772 | A | 7/2014 |
| JP | H02113002 | U | 9/1990 |
| JP | 2007091052 | A | 4/2007 |
| JP | 2007265961 | A | 10/2007 |
| JP | 2011060450 | A2 | 3/2011 |
| JP | 2012064551 | A2 | 3/2012 |
| JP | 2015002027 | A2 | 6/2013 |
| JP | 2015002028 | A2 | 1/2015 |
| JP | 20171076699 | A2 | 6/2017 |
| KR | 1020110008796 | A | 1/2011 |
| KR | 1020120061625 | A | 6/2012 |
| MX | 2011002947 | A | 9/2011 |
| TW | 474382 | U | 1/2002 |
| WO | WO 2013/128896 | A1 | 9/2013 |
| WO | WO 2015/000212 | A1 | 1/2015 |
| WO | WO 2016152166 | A2 | 8/2016 |

OTHER PUBLICATIONS

Non-Final Office Action dated Apr. 12, 2018 for U.S. Appl. No. 29/638,259, 5 pages.

Non-Final Office Action dated May 16, 2018 for U.S. Appl. No. 15/132,875, 18 pages.

Notice of Allowance dated May 10, 2018 from U.S. Appl. No. 14/726,064, 7 pages.

(56) References Cited

OTHER PUBLICATIONS

2006 International Building Code, Section 712 Penetrations, 2006, 4 pages.
BXUV.GuideInfo, Fire Resistance Ratings—ANSI/UL 263, UL Online Certifications Directory, last updated Nov. 3, 2016, 27 pages.
CEYY.GuideInfo, Outlet Boxes and Fittings Certified for Fire Resistance, UL Online Certifications Directory, last updated May 16, 2013, 2 pages.
Canadian Office Action dated Dec. 23, 2013 from Canadian Application No. 2,778,581, 3 pages.
Canadian Office Action dated Mar. 22, 2016 from Canadian Application No. 2,879,629, 4 pages.
Canadian Office Action dated Dec. 6, 2016 from Canadian Application No. 2,879,629, 3 pages.
Canadian Office Action dated Mar. 9, 2017 from Canadian Application No. 2,931,588, 5 pages.
Canadian Office Action dated Feb. 1, 2016 from Canadian Application No. 2,879,486, 5 pages.
Canadian Office Action dated Jun. 12, 2017 from Canadian Application No. 2,927,601, 4 pages.
Canadian Office Action dated Aug. 11, 2017 from Canadian Application No. 2,941,051, 4 pages.
DME Series Installation Instructions, Oct. 18, 2011, 2 pages.
DMF, Inc., "dmfLIGHTING: LED Recessed Lighting Solutions," Info sheets, Mar. 19, 2012, 4 pages.
DMF, Inc., "dmfLIGHTING: LED Recessed Downlighting," DRD2 Product Brochure, Oct. 23, 2014, 50 pages.
DMF, Inc., "dmfLIGHTING: LED Recessed Downlighting," Product Catalog, Aug. 2012, 68 pages.
Final Office Action dated Apr. 27, 2016 from U.S. Appl. No. 14/184,601, 19 pages.
Final Office Action dated Jul. 26, 2017 from U.S. Appl. No. 14/184,601, 18 pages.
Final Office Action dated Jan. 29, 2016 from U.S. Appl. No. 14/183,424, 21 pages.
Final Office Action dated Jun. 23, 2016 from U.S. Appl. No. 13/484,901, 18 pages.
Final Office Action dated Apr. 2, 2015 from U.S. Appl. No. 13/484,901, 13 pages.
HALO, HALO LED H4 H7 Collection, SustainabLEDesign, Cooper Lighting, (emphasis on p. 18 "H7 Collection LED Modules—HALO LED H7 Module Features,") Mar. 28, 2012, 52 pages.
HALO, H7 LED Downlight Trims 49x Series, 6-inch LED Trims for Use with Ml7x LED Modules, Cooper Lighting, ADV110422, rev. Aug. 12, 2011, 15 pages.
HALO, LED Module ML706x, Cooper Lighting, General Installation for All Modules/p. 1; Tether Installation/pp. 2-3; Installation into HALO H750x Series LED—only (Non-Screw Based), Recessed Fixture, p. 4, Oct. 20, 20019, 4 pages.
"Membrane Penetrations in Fire-Resistance Rated Walls," https://www.ul.com/wp-content/uploads/2014/04/ul_MembranePenetrations.pdf, Issue 1, 2009, 2 pages.
"Metallic Outlet Boxes," UL 514A, Underwriters Laboratories, Inc., Feb. 16, 2004 (Title Page Reprinted Aug. 10, 2007), 106 pages.
"Metallic and Non-metallic Outlet Boxes Used in Fire-rated Assembly," https://iaeimagazine.org/magazine/2000/09/16/metallic-and-non-metallic-outlet-boxes-used-in-fire-rated-assembly/, Sep. 16, 2000, 5 pages.
Non-Final Office Action dated Mar. 15, 2010 from U.S. Appl. No. 12/100,148, 8 pages.
Non-Final Office Action dated Apr. 30, 2010 from U.S. Appl. No. 12/173,232, 13 pages.
Non-Final Office Action dated Sep. 5, 2014 from U.S. Appl. No. 13/791,087, 8 pages.
Non-Final Office Action dated Jul. 20, 2015 from U.S. Appl. No. 14/184,601, 16 pages.
Non-Final Office Action dated Dec. 15, 2016 from U.S. Appl. No. 14/184,601, 18 pages.
Non-Final Office Action dated Feb. 6, 2018 from U.S. Appl. No. 15/167,682, 9 pages.
Non-Final Office Action dated Sep. 15, 2015 from U.S. Appl. No. 13/484,901, 16 pages.
Non-Final Office Action dated Oct. 16, 2014 from U.S. Appl. No. 13/484,901, 11 pages.
Non-Final Office Action dated Sep. 6, 2017 from U.S. Appl. No. 14/726,064, 8 pages.
Non-Final Office Action dated May 17, 2017 from U.S. Appl. No. 14/183,424, 20 pages.
Non-Final Office Action dated Jun. 2, 2015 from U.S. Appl. No. 14/183,424, 20 pages.
Notice of Allowance dated Jan. 30, 2015 from U.S. Appl. No. 13/791,087, 9 pages.
Notice of Allowance dated Jan. 16, 2015 from U.S. Appl. No. 29/467,026, 9 pages.
Notice of Allowance dated Oct. 21, 2016 from U.S. Appl. No. 13/484,901, 7 pages.
Notice of Allowance dated Mar. 24, 2016 from U.S. Appl. No. 14/247,149, 8 pages.
Notice of Allowance dated Aug. 23, 2017 from Canadian Application No. 2,879,629, 1 page.
"Outlet Boxes for Use in Fire Rated Assemblies," https://www.ulcom/wp-content/uploads/2014/04/Ul_outletboxes.pdf, 2011, 2 pages.
Acrich COB Zhaga Module, Product Description, Seoul Semiconductor, Nov. 2016, 39 pages.
<https://www.zhagastandard.org/books/book18/>, Mar. 2017, 5 pages.
"Better light is beautiful light; it makes colors appear richer, true and natural," We Believe in Better Light, Apr. 24, 2017, 2 pages, CREE.
Notice of Allowance dated May 22, 2018 from U.S. Appl. No. 14/183,424, 9 pages.
"Advanced LED Solutions," Imtra Marine Lighting. 2011. 39 pages.
"Cree LMH2 LED Module with TrueWhite Technology," Cree Product Family Data Sheet. 2011. 3 pages.
"Cree LMH2 LED Modules Design Guide," Cree Product Design Guide. 2011. 20 pages.
"Cree LMH2 LED Modules," Mouser Electronics. 2 pages.
"LED Undercabinet Pocket Guide," ELCO Lighting.12 pages.
"Portland Bi-Color, Warm White/Red," item:ILIM30941.Imtra Marine Products. 2012. 3 pages.
"Undercabinet Pucks, Xyris Mini LED Puck Light," ELCO Lighting. Sep. 2018. 1 page.
"VERSI LED Mini Flush," Lithonia Lghting. 6 pages.
International Search Report and Written Opinion in International Patent Application No. PCT/US18/39048 dated Dec. 14, 2018. 24 pages.
International Search Report and Written Opinion in PCT/US2018/048357 dated Nov. 14, 2018, 13 pages.
Non-Final Office Action dated Dec. 5, 2018 from U.S. Appl. No. 14/942,937, 13 pages.
Non-Final Office Action dated Jun. 25, 2018 for U.S. Appl. No. 29/541,565, 10 pages.
Non-Final Office Action dated Oct. 24, 2018 for U.S. Appl. No. 15/688,266, 14 pages.
Notice of Allowance dated Nov. 27, 2018 from U.S. Appl. No. 15/167,682, 11 pages.
Notice of Allowance dated Oct. 9, 2018 from U.S. Appl. No. 29/653,142, 7 pages.
Notice of Allowance dated Sep. 19, 2018 from U.S. Appl. No. 15/167,682 , 7 pages.
Notice of Allowance dated Sep. 21, 2018 from U.S. Appl. No. 29/645,941, 5 pages.
OneFrame Recessed LED Downlight. Dmflighting.com. Published Jun. 6, 2018. Retrieved at https://www.dmflighting.com/product/oneframe on Jun. 6, 2018. 11 pages.
Notice of Allowance dated Jan. 2, 2019 from U.S. Appl. No. 29/541,565, 6 pages.
RACO 4 in. Octagon Welded Concrete Ring, 6 in. Deep with 1/2 and 3/4 in. Knockouts (10-Pack). Model # 276. Accessed at https://www.homedepot.com/p/RACO-4-in-Octagon-Welded-Concrete-Ring-6-in-Deep-with-1-2-and-3-4-in-Knockouts-10-Pack-276/203638675 on Jan. 16, 2019. 4 pages.
RACO 4 in. Octagon Welded Concrete Ring, 3-1/2 in. Deep with 1/2 and 3/4 in. Knockouts and ilcludes 890 cover (20-Pack). Model

(56) References Cited

OTHER PUBLICATIONS

280. Accessed at https://www.homedepot.com/p/RACO-4-in-Octagon-Welded-Concrete-Ring-3-1-2-in-Deep-with-1-2-and-3-4-in-Knockouts-and-ilcludes-890-cover-20-Pack-280/203638679 on Jan. 18, 2019. 3 pages.
Civil Action No. 2:18-cv-07090. Complaint for Infringement and Unfair Competition. *DMF, Inc.* v. *AMP Plus, Inc.* d/b/a ELCO Lighting. 52 pages. Dated Aug. 15, 2018.
Notice of Allowance dated Feb. 8, 2019 from U.S. Appl. No. 29/541,565, 5 pages.
Non-Final Office Action dated Febraury 7, 2019 from U.S. Appl. No. 16/200,393, 32 pages.
Notice of Allowance dated Jan. 28, 2019 from U.S. Appl. No. 29/664,471, 8 pages.
Non-Final Office Action dated Jul. 24, 2018 from U.S. Appl. No. 29/638,259, 5 pages.
Final Office Action dated Mar. 15, 2019 from U.S. Appl. No. 15/132,875, 15 pages.
International Search Report and Written Opinion in International Patent Application No. PCT/US18/62868 dated Mar. 14, 2019, 13 pages.
CS&E PCT Collaborative Search and Examination Pilot Upload Peer Contribution mailed Mar. 14, 2019, 61 pages.
Notice of Allowance dated Apr. 1, 2019 from U.S. Appl. No. 15/167,682, 7 pages.
Non-Final Office Action dated Apr. 4, 2019 from U.S. Appl. No. 29/678,482, 8 pages.
Notice of Allowance dated Apr. 8, 2019 from U.S. Appl. No. 29/653,142, 8 pages.
Notice of Allowance dated Apr. 17, 2019 from U.S. Appl. No. 29/678,478, 7 pages.
International Search Report and Written Opinion in International Patent Application No. PCT/US18/67614 dated Apr. 25, 2019, 20 pages.
CS&E PCT Collaborative Search and Examination Pilot Upload Peer Contribution mailed Apr. 24, 2019, 53 pages.
Specification & Features 4" Octagonal Concrete Box Covers. Orbit Industries, Inc. Accessed at https://www.orbitelectric.com on May 6, 2019. 1 page.
4" Octagon Concrete Boxes and Back Plates. Appleton. Accessed at www.appletonelec.com on May 6, 2019. 1 page.
RACO Commercial, Industrial and Residential Electrical Products. Hubbell. Accessed at www.Hubbell-RTB.com on May 6, 2019. 356 pages.
Imtra Marine Lighting 2008 Catalog. 40 pages.
Imtra Marine Lighting 2009 Catalog. 32 pages.
Imtra Marine Lighting Spring 2007 Catalog. 36 pages.
Cooper Lighting Halo ML56 LED System Product Sheet. Mar. 2, 2015. Accessed at http://www.cooperindustries.com/content/dam/public/lighting/products/documents/halo/spec_sheets/halo-ml56600-80cri-141689-sss.pdf. 8 pages.
Ex-Parte Quayle Action mailed Jun. 27, 2019 from U.S. Appl. No. 29/683,730, 5 pages.
Final Office Action dated Jun. 6, 2019 from U.S. Appl. No. 15/688,266, 7 pages.
IC1JB Housing 4" IC-Rated New Construction Junction Box Housing. AcuityBrands. Accessed at https://www.acuitybrands.com/en/products/detail/845886/juno/ic1jb-housing/4-ic-rated-new-construction-junction-box-housing on Jun. 27, 2019.
IPR2019-01094 Exhibit 1001. U.S. Pat. No. 9,964,266 ("the '266 Patent"). 14 pages.
IPR2019-01094 Exhibit 1002. Declaration of Eric Bretschneider, Ph.D. ("Bretschneider"). 107 pages.
IPR2019-01094 Exhibit 1003. Curriculum Vitae of Dr. Bretschneider. 11 pages.
IPR2019-01094 Exhibit 1004. Excerpts from the File History of U.S. Pat. No. 9,964,266. 105 pages.
IPR2019-01094 Exhibit 1005. Imtra 2011 Marine Lighting Catalog—Advanced LED Solutions ("Imtra 2011"). 40 pages.
IPR2019-01094 Exhibit 1006. lmtra 2007 Marine Lighting Catalog ("Imtra 2007"). 36 pages.
IPR2019-01094 Exhibit 1007. U.S. Pat. No. 9,366,418 ("Gifford"). 9 pages.
IPR2019-01094 Exhibit 1008. Declaration of Colby Chevalier ("Chevalier"). 89 pages.
IPR2019-01094 Exhibit 1009. U.S. Pat. No. 7,102,172 ("Lynch"). 41 pages.
IPR2019-01094 Exhibit 1010. Illuminating Engineering Society, ANSI RP-16-10, Nomenclature and Definitions for Illuminating Engineering (approved as an American National Standard Jul. 15, 2005, approved by the IES Board of Directors Oct. 15, 2005). 4 pages.
IPR2019-01094 Exhibit 1011. Underwriters Laboratories Inc. Standard for Safety, Standard UL-8750, entitled Light Emitting Diode (LED) Equipment for Use in Lighting (1st ed. 2009). 5 pages.
IPR2019-01094 Exhibit 1012. Celanese CoolPoly® D5502 Thermally Conductive Liquid Crystalline Polymer Specification ("CoolPoly"). 1 page.
IPR2019-01094 Exhibit 1013. Illuminating Engineering Society of North America, IES Lighting Handbook (John E. Kaufman and Howard Haynes eds., Application vol. 1981) ("Lighting Handbook"). 5 pages.
IPR2019-01094 Exhibit 1014. California Energy Commission, PIER Lighting Research Program: Project 2.3 Low-profile LED Luminaires Final Report (Prepared by Lighting Research Center, Jan. 2005) ("PIER LRP"). 70 pages.
IPR2019-01094 Exhibit 1015. Jim Sinopoli, Using DC Power to Save Energy and End the War on Currents, GreenBiz (Nov. 15, 2012), https://www.greenbiz.com/news/2012/11/15/using-dc-power-save-energy-end-war-currents ("Sinopoli"). 6 pages.
IPR2019-01094 Exhibit 1016. Robert W. Johnson, "Thought Leadership White Paper: AC Versus DC Power Distribution" (Nov. 2012) ("Johnson"). 10 pages.
IPR2019-01094 Exhibit 1017. Lumileds, LUXEON Rebel General Purpose Product Datasheet, Specification DS64 (2016) ("Luxeon Rebel"). 26 pages.
IPR2019-01094 Exhibit 1018. U.S. Pat. No. 8,454,204 ("Chang"). 11 pages.
IPR2019-01094 Exhibit 1019. U.S. Department of Energy, CALiPER Benchmark Report: Performance of Incandescent A-Type and Decorative Lamps and LED Replacements (prepared by Pacific National Laboratory, Nov. 2008) ("CALiPER 2008"). 25 pages.
IPR2019-01094 Exhibit 1020. U.S. Pat. No. 3,836,766 ("Auerbach"). 13 pages.
IPR2019-01094 Exhibit 1021. U.S. Department of Energy, CALiPER Application Summary Report 16: LED BR30 and R30 Lamps (prepared by Pacific Northwest National Laboratory, Jul. 2012) ("CALiPER 2012"). 26 pages.
IPR2019-01094 Exhibit 1022. Sandia National Laboratories, Sandia Report: "The Case for a National Research Program on Semiconductor Lighting" (Jul. 2000) ("Haitz"). 24 pages.
IPR2019-01094 Exhibit 1023. Sylvania, Post Top Street Light LED Retrofit Kit Specification, LED40POST (2009) ("Sylvania"). 4 pages.
IPR2019-01094 Exhibit 1024. Webster's New Collegiate Dictionary (1973) ("Webster's"). 2 pages.
IPR2019-01094 Exhibit 1025. 3M Wire Connectors and Tools Catalog 2013 ("3M Catalog"). 22 pages.
IPR2019-01094 Exhibit 1026. Wakefield Semiconductor Heat Sinks and Thermal Products 1974 Catalog ("Wakefield"). 3 pages.
IPR2019-01094 Exhibit 1027. U.S. Department of Energy, Solid-State Lighting Research and Development Portfolio: Multi-Year Program Plan FY'07-FY'12 (prepared by Navigant Consulting, Inc., Mar. 2006) ("DOE 2006"). 129 pages.
IPR2019-01094 Exhibit 1028. U.S. Department of Energy, Solid-State Lighting Research and Development: Multi-Year Program Plan (Apr. 2013) ("DOE 2013"). 89 pages.
Kwikbrace@ New Construction Braces for Lighting Fixtures or Ceiling Fans 1-1/2 in. Depth. Hubbel. Accessed at https://hubbellcdn.com/specsheet/926.pdf on Jun. 27, 2019. 1 page.
Non-Final Office Action dated Jun. 11, 2019 from U.S. Appl. No. 15/901,738, 6 pages.

(56) References Cited

OTHER PUBLICATIONS

Notice of Allowance dated Jun. 12, 2019 from U.S. Appl. No. 16/016,040, 8 pages.
Petition for Inter Partes Review of U.S. Pat. No. 9,964,266 Pursuant to 37 C.F.R. § 42.100 et seq. *AMP Plus Inc. dbd ELCO Lighting* v. *DMF, Inc*, IPR2019-01094 filed May 17, 2019. 108 pages.
Declaration of Colby Chevalier from Central District of California Civil Docket for Case #: 2:18-cv-07090-CAS-GJS filed Jun. 3, 2019, signed Jun. 3, 2019. 2 pages.

* cited by examiner

RECESSED LIGHTING SYSTEMS

CROSS-REFERENCE TO RELATED APPLICATION

This application is a continuation (CON) application of U.S. application Ser. No. 14/184,601, filed Feb. 19, 2014, which claims the benefit of the earlier filing date of U.S. provisional application No. 61/843,278, filed Jul. 5, 2013.

FIELD

An embodiment relates to a compact recessed lighting system that includes a light source module and a driver in a single unified casting, which along with an optical light reflector shields the driver from exposure to outside elements and allows the recessed lighting system to be installed in a standard junction box. In some embodiments, this compact recessed lighting system may be utilized in 4-10" recessed new construction and remodel products and in retrofit applications. Moreover, in some embodiments, this compact recessed lighting system may be utilized with interchangeable trims to accommodate different aperture luminaires. Other embodiments are also described.

BACKGROUND

Recessed lighting systems are typically installed or mounted into an opening in a ceiling or a wall. Recessed lighting systems generally consist of a trim, a light source module, a driver, and a "can" housing. The driver is insulated from other portions and components of the recessed lighting system, including the light source module, through the use of a separate insulating container. The driver may be electrically coupled to the light source module through the use of wires or other conduits such that the driver may power the light source module to emit light.

The separation between the driver and the light source module adds to the combined size of the recessed lighting system. In particular, the use of a separate container that houses the driver separate from the other portions and components of the recessed lighting system, including the light source module, increases the size of the recessed lighting system. This increased size restricts the recessed lighting system to be placed in constrained spaces within a ceiling or a wall and may increase the overall cost of the recessed lighting system.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
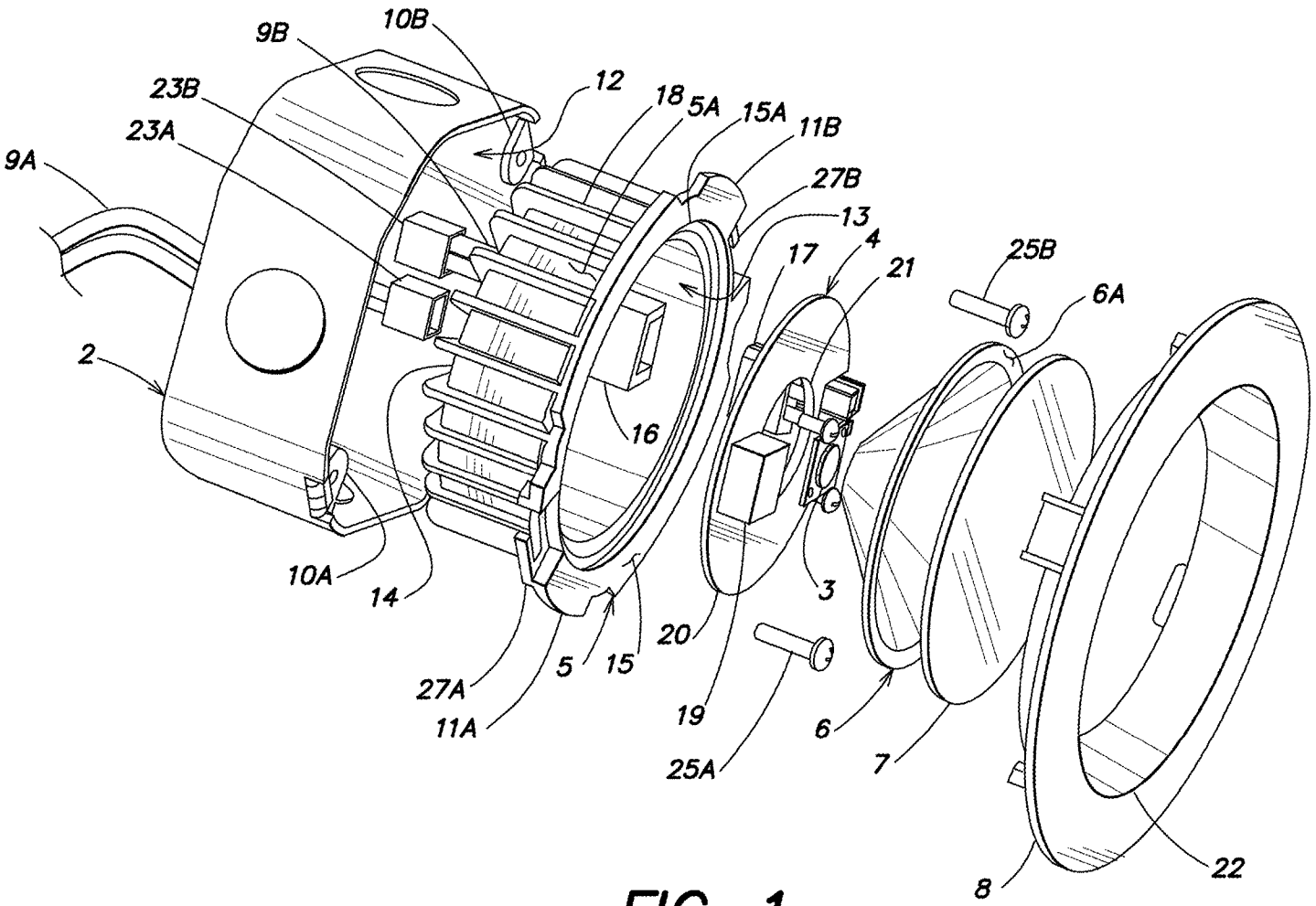
FIG. 1 shows an exploded view of a recessed lighting system according to one embodiment.

FIG. 1 shows an exploded view of a recessed lighting system 1. The recessed lighting system 1 may include a junction box 2, a light source module 3, a driver (e.g., a power supply) 4, a unified casting 5, a reflector 6, a lens 7, and a trim 8. As will be described in further detail below, the recessed lighting system 1 provides a more compact and cost effective design while complying with all building and safety codes/regulations. Although shown with a single junction box 2 and trim 8, the light source module 3, the driver 4, the unified casting 5, the reflector 6, and the lens 7 may be similarly used with different sized junction boxes 2 and trims 8. Each of the elements of the recessed lighting system 1 will be explained by way of example below.

The junction box 2 is a structure that separates the inner components of the recessed lighting system 1, including electrical wires/cables, from the items inside a ceiling or crawl space (e.g., insulation) in which the junction box 2 has been installed. In one embodiment, the junction box 2 is directly coupled to a stud, beam, or other structural member inside the ceiling or crawl space through the use of resins, clips, screws, bolts, clamps, or any other type of connecting mechanism. The junction box 2 may be equipped with one or more bar-hangers to assist installation when the junction box 2 needs to be located between two studs or joists. In one embodiment, the junction box 2 may be a single or double gang box with a fire rating of up to two hours as described in the National Electrical Code (NEC) and by the Underwriters Laboratories (UL). The junction box 2 may receive electrical wires 9A from an electrical system (e.g., 120 VAC or 277 VAC) within a building or structure in which the recessed lighting system 1 is installed. The electrical wires 9A from the structure may be connected to corresponding wires 9B of the unified casting 5, as will be described in greater detail below.

In one embodiment, the junction box 2 may include one or more tabs 10A, 10B for coupling the junction box 2 to the casting 5. The tabs 10A, 10B may be any device/component for receiving corresponding elements 27A, 27B of the casting 5 to firmly hold the weight of the unified casting 5, the light source module 3, the driver 4, the reflector 6, the lens 7, and/or the trim 8 up against the junction box 2. As shown in FIG. 1, the tabs 10A, 10B include holes for receiving screws or bolts 25A, 25B through the corresponding elements 27A, 27B; however, in other embodiments the tabs 10A, 10B may facilitate a twist-and-lock friction connection with corresponding elements 27A, 27B of the casting 5 and without the use of separate tools or other devices. In still other embodiments, friction or tension clips may be utilized to couple the casting 5 to the junction box 2.

Figure 2:
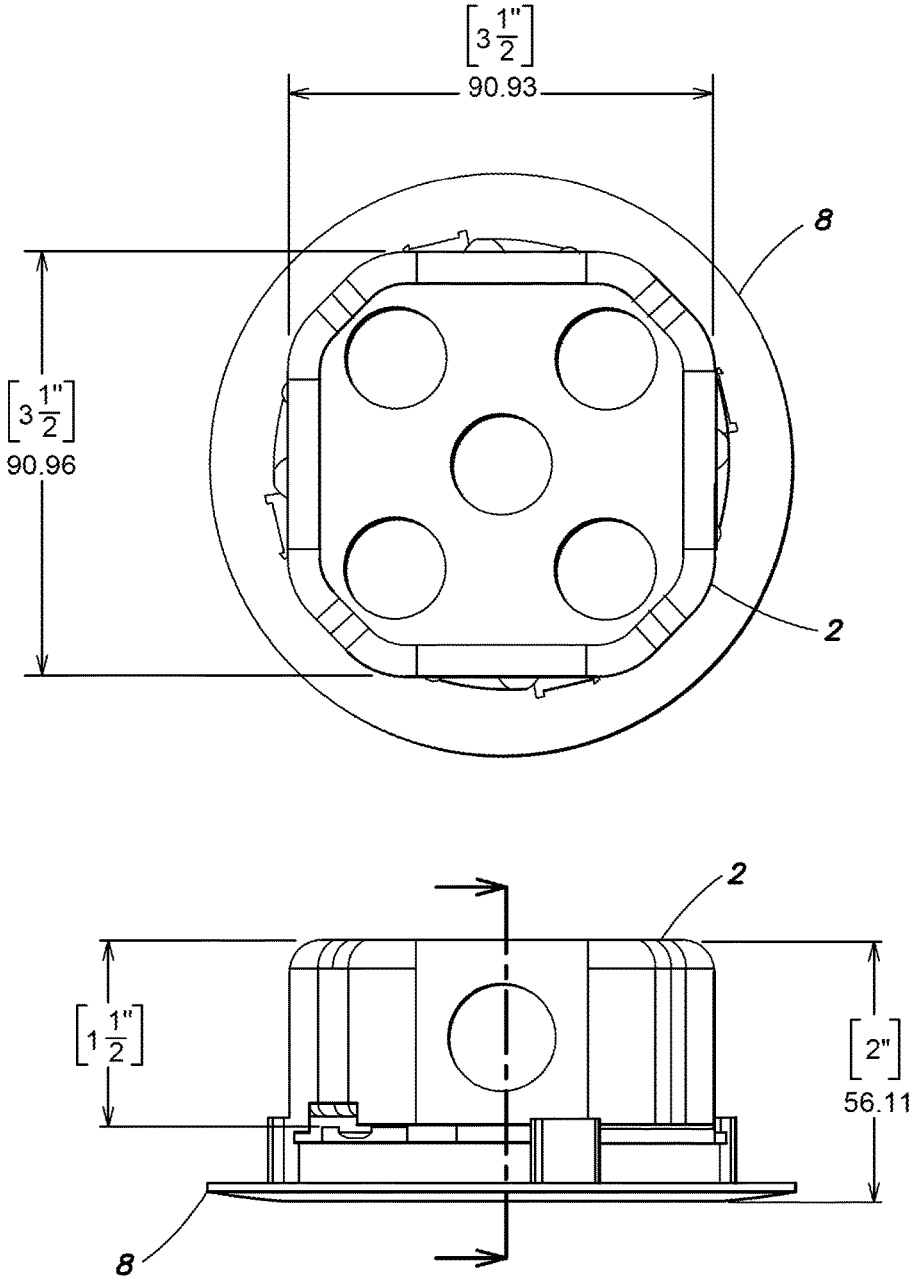
FIG. 2 shows top and side views of a junction box according to one embodiment.

In one embodiment, the junction box 2 acts as a heat barrier to block heat emitted by the light source module 3 and the driver 4 from reaching possibly flammable items inside a ceiling or crawl space. In these embodiments, the junction box 2 may be formed of metals, polymers, metal alloys, and/or other heat insulating materials. As shown in FIG. 1, the junction box 2 may be a polygon that defines a cavity 12 therein. However, in other embodiments, the junction box 2 may be any suitable shape, including an ellipsoid, cone, or cylinder that is capable of receiving therein the casting 5. The cavity 12 that is formed in the junction box 2 may be larger than the casting 5 such that the casting 5 may easily fit into the cavity 12 without coming into direct contact with the walls of the cavity 12. However, in other embodiments, the casting 5 may be sized to come into direct contact with the walls of the cavity 12. The size of the cavity 12 may be pursuant to popular industry specifications for junction boxes and in compliance with all applicable building and safety codes/regulations. For example, as shown in FIG. 2, the junction box 2 may have a length of 3½ inches, a width of 3½ inches and a depth of 1½ inches. When coupled together, the combined junction box 2, light source module 3, driver 4, casting 5, reflector 6, lens 7, and trim 8 may have a height/depth of 2 inches.

Figure 3:
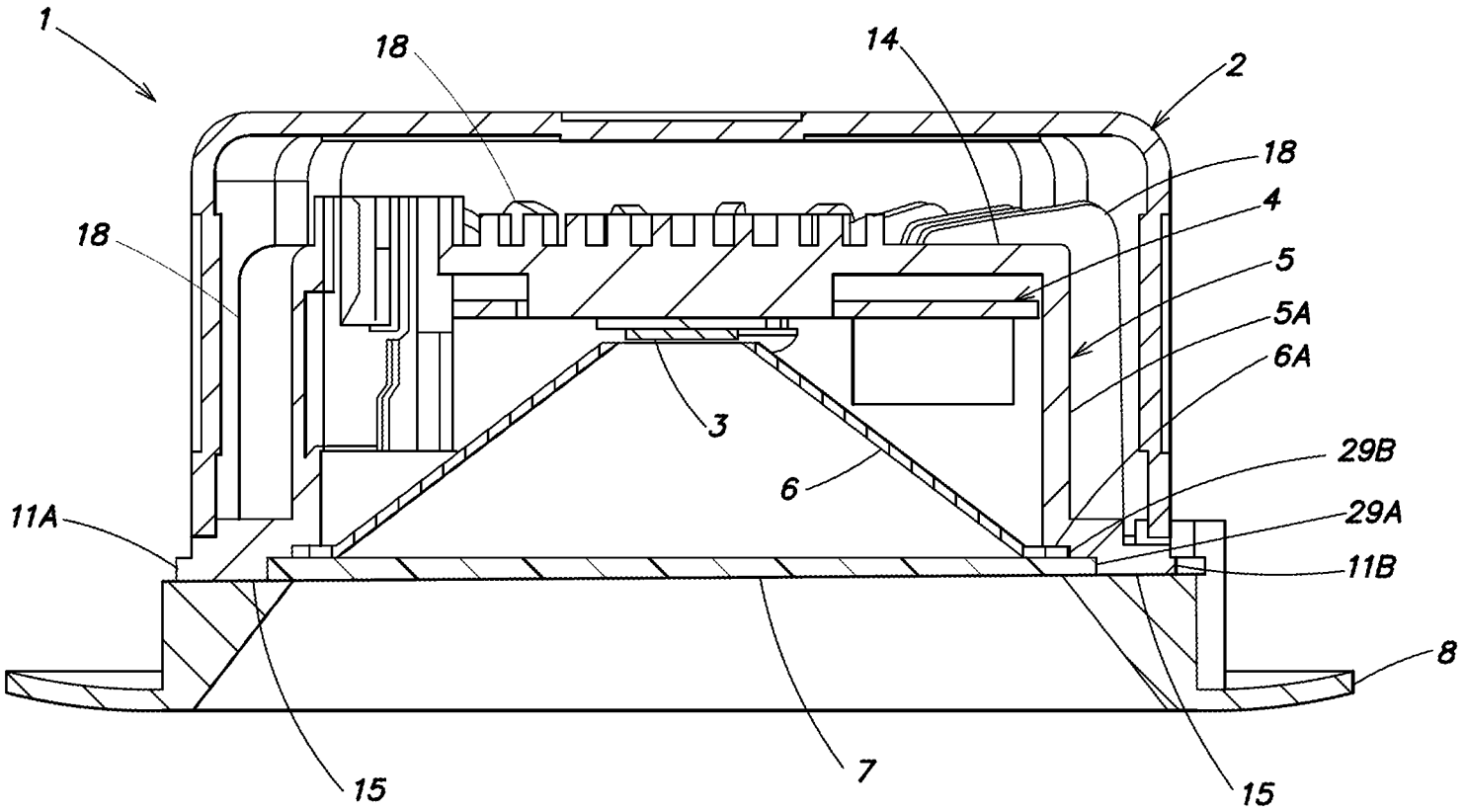
FIG. 3 shows a side view of the recessed lighting system according to one embodiment.

The junction box 2 is a shell and/or enclosure that further prevents the exposure of heat from the light source module 3 and the driver 4 to the items inside a ceiling or crawl space (e.g., insulation) in which the recessed lighting system 1 has been installed. The casting 5 may be formed of metals, polymers, metal alloys, and/or other materials. As shown in FIG. 1, the casting 5 may be a cylindrical structure that defines a casting cavity 13 therein. However, in other embodiments, the casting 5 may be any suitable shape, including an ellipsoid, cone, or polygon that is capable of housing the light source module 3 and the driver 4. As shown in FIGS. 1 and 3, the cavity 13 is to receive therein the light source module 3 and the driver 4.

In one embodiment, the casting 5 may include a closed rear face 14 and an open front face 15*a*. The closed rear face 14 allows the light source module 3 and the driver 4 to be securely mounted to the casting 5, while the open front face 15*a* provides an aperture to allow light emitted by the light source module 3 to be exposed to an outside environment surrounding the recessed lighting system 1 (e.g., into a room). In one embodiment, the rear face 14 of the casting 5 may include one or more mounting elements for receiving and securely holding the light source module 3 and the driver 4. In some embodiments, the mounting elements may be holes, flaps, or other structures designed to receive the light source module 3 and the driver 4. The mounting elements may be capable of receiving resins, clips, screws, bolts, clamps, or any other type of connecting mechanism such that the light source module 3 and the driver 4 may be securely coupled inside the cavity 13 on the rear face 14 of the casting 5. In one embodiment, the light source module 3 and the driver 4 are removably coupled to the casting 5 while in other embodiments one or more of the light source module 3 and the driver 4 form a single continuous and indivisible component with the casting 5.

Although described as a casting 5, the casting 5 may be formed through other processes other than casting techniques. For example, the casting 5 may be formed through an extrusion process or formed through the welding of metal sheets to form a structure. Further, although described as an enclosed assembly, the casting 5 may be any heat conducting structure to which the light source module 3 and the driver 4 are mounted and which can be mounted, using any type of fasteners or mounting elements, to the junction box 2.

In one embodiment, the electrical wires 9A received by the junction box 2 from the electrical system of a building or structure may be coupled to the electrical wires 9B of the casting 5. The electrical wires 9A may be coupled to the electrical wires 9B through the use of electrical caps or other devices. For example, as shown in FIG. 1, the electrical wires 9A and 9B may be connected using the connectors 23A and 23B. The connectors 23A and 23B are complimentary, keyed or interlocking connectors. The electrical wires 9B of the casting 2 may terminate in a connector holder 16 that may receive a corresponding connector 17 of the driver 4. In one embodiment, the connectors 16 and 17 are complimentary, keyed or interlocking connectors similar to the connectors 23A and 23B described above. When the connectors 16 and 17 are engaged, electricity may pass from the electrical system of the building or structure to the driver 4.

In one embodiment, the casting 5 includes one or more heat sinks 18 to dissipate heat generated by the light source module 3 and/or the driver 4. Although the heat sinks 18 are shown as passive components that cool the combined casting 5, light source module 3, and driver 4 by dissipating heat into the surrounding air, active heat sinks (e.g., fans) may also be used. In one embodiment, the heat sinks 18 are defined by a set of fins surrounding the casting 5. The heat sinks 18 may be composed of any thermally conductive material. For example, the heat sinks 18 may be made of aluminium alloys, copper, copper-tungsten pseudoalloy, AlSiC (silicon carbide in aluminium matrix), Dymalloy (diamond in copper-silver alloy matrix), E-Material (beryllium oxide in beryllium matrix), and/or thermally conductive plastics or ceramics.

As described above, the recessed lighting system 1 may include the driver 4. The driver 4 is an electronic device that supplies and/or regulates electrical energy to the light source module 3 and thus powers the light source module 3 to emit light. The driver 4 may be any type of power supply, including power supplies that deliver an alternating current (AC) or a direct current (DC) voltage to the light source module 3. In one embodiment, the driver 4 receives electricity from the casting 5 via a connector. In one embodiment, the connector 17 is coupled to the connector holder 16 of the casting 5 such that electrical wires are not protruding from the casting 5. In this embodiment, the supply connection from the driver 4 terminates in connector 17, which is force-fitted into connector holder 16. In another embodiment, the driver 4 may connect to the supply wires, 9A, via wire nuts.

Upon receiving electricity, the driver 4 may regulate current or voltage to supply a stable voltage or current within the operating parameters of the light source module 3. The driver 4 receives an input current from the electrical system of the building or structure in which the recessed lighting system 1 is installed and drops the voltage of the input current to an acceptable level for the light source module 3 (e.g., from 120V-240V to 36V-48V). The driver 4 may transfer electricity to the light source module 3 through an electrical connector. For example, the driver 4 may deliver electricity to the light source module 3 through an electrical cable coupled between the light source module 3 and the driver 4 through removable or permanent connectors or soldered leads originating from the driver 4. Although shown with magnetic transformer 19, the driver 4 may include additional circuitry for regulating current to the light source module 3.

As shown in FIG. 1, the driver 4 may also include the board 20 for holding the magnetic transformer 19 and other circuitry. In one embodiment, the board 20 is formed in a "donut", torus, or "C" shape with an opening 21. The outside edge of the board 20 is coupled to the casting 5, while the opening 21 formed by the board 20 allows the light source module 3 to be directly coupled to the casting 5 without coming into direct contact with the driver 4. By forming a structure with the opening 21, the driver 4 allows the light source module 3 to avoid the driver 4, eliminating shadows or interference from the driver 4, and allows the light source module 3 to directly contact the casting 5, assisting the casting 5 to dissipate heat generated by the light source module 3. This compact structure allows the light source module 3 and the driver 4 to be contained within the unified casting 5, which in turn may fit inside a standard junction box (i.e., junction box 2) and/or a 4-8 inch recessed lighting fixture (both incandescent and non-incandescent). Accordingly, the recessed lighting system 1 can operate without the use of a "can" housing structure. This simplified and more compact structure reduces the cost and complexity of installing the recessed lighting structure 1 into an existing/pre-installed junction box or a newly installed junction box. Further, this configuration allows the recessed lighting system 1 to achieve a UL fire-rating of at least two hours.

In one embodiment, the board 20 may be a printed circuit board. The driver 4 may be coupled to the casting 5 using any connecting mechanism, including resins, clips, screws, bolts, or clamps. For example, in one embodiment, the driver 4 may be coupled to the casting 5 using friction or tension clips.

The light source module 3 may be any electro-optical device or combination of devices for emitting light. For example, the light source module 3 may have as a single light source a light emitting diode (LED), organic light-emitting diode (OLED), or polymer light-emitting diode (PLED). In some embodiments, the light source module 3 may have multiple light sources (e.g., LEDs, OLEDs, and/or PLEDs). The light source module 3 receives electricity from the driver 4, as described above, such that the light source module 3 may emit a controlled beam of light into a room or surrounding area. The driver 4 is designed to ensure that the approximate voltage and current are fed to the light source module 3 to enable the emission of light by the one or more light sources within the light source module 3.

As described above and shown in FIG. 1, the light source module 3 is coupled to the casting 5 in the opening 21 formed by the board 20. As described above, by positioning the light source module 3 in the opening 21, the light source module 3 may avoid the driver 4, thus eliminating shadows or interference from the driver 4, and allowing the light source module 3 to directly contact the casting 5, such that the casting 5 can dissipate heat generated by the light source module 3. Further, this compact design allows the recessed lighting system 1 to utilize a standard sized junction box (e.g., junction box 2) instead of a "can" housing structure. As shown in FIG. 1, the light source module 3 is coupled to the casting 5 using screws; however, in other embodiments, the light source module 3 may be coupled to the casting 5 using any connecting mechanism, including resins, clips, screws, bolts, or clamps. For example, in one embodiment, the light source module 3 may be coupled to the casting 5 using friction or tension clips.

In one embodiment, the casting 5 may include an insulating gasket 25 that separates the board 20 and the casting 5. The insulating gasket 25 may be placed on a groove 24 that encircles the open front face 15*a* of the casting 5. The insulating gasket 25 may be formed of materials that provide some degree of malleability and/or flexibility such that the gasket 25 is able to deform and tightly fit within the groove 24, including any slight irregularities. For example, the insulating gasket 25 may be formed of plastic, rubber, metal, and/or ceramic materials. The insulating gasket 25 assists in insulating the driver 4 from the outside environment.

In some embodiments, the recessed lighting system 1 may include the reflector 6. The reflector 6 may surround the light source module 3 and/or a light source of the light source module 3 to adjust the way light emitted by the light source module 3 is focused inside a room or surrounding area. In one embodiment, the reflector 6 surrounds the light source module 3 and separates the light source module 3 from the driver 4. This separation allows light from the light source module 3 to be emitted into a room or surrounding area while further shielding the driver 4 from being exposed to the room or surrounding area. For example, in one embodiment, the reflector 6 and the casting 5 may be coupled together such that the combined assembly may create a sealed structure to shield the driver 4 from the outside environment and the light source module 3. By shielding the driver 4 from the outside environment, the reflector 6 reduces the risk of fire or other dangers and ensures the recessed lighting system 1 complies with building and safety codes/regulations. The reflector 6 may be formed of any fire retardant material, including steel, aluminum, metal alloys, calcium silicate, and other similar materials.

In one embodiment, the reflector 6 may be coupled to the casting 5 using screws, rivets or other fasteners. The reflector 6 may also be designed as a snap fit into the casting 5.

Although shown as conical, the reflector 6 may be formed in any shape that may direct and/or focus light. For example, the reflector 6 may be parabolic, spherical, or a frusto-conical shape that is positioned over the light source module 3 while shielding the driver 4. In one embodiment, the reflector 6 may be coated with a reflecting material or include one or more reflecting elements that assist in the adjustment of light emitted by the light source module 3. For example, the reflector 6 may be coated with a shiny enamel or include one or more mirrors or retroreflectors or a microcellular polyethylene terephthalate (MCPET) material to adjust the focus of light emitted by the light module 3. In other embodiments, the reflector 6 may include various other optic elements to assist in the focusing of light emitted by the light source module 3.

In one embodiment, the recessed lighting system 1 may include a lens 7. The lens 7 may be formed to converge or diverge light emitted by the light source module 3. The lens 7 may be a simple lens comprised of a single optical element or a compound lens comprised of an array of simple lenses (elements) with a common axis. In one embodiment, the lens 7 also provides a protective barrier for the light source module 3 and shields the light source module 3 from moisture or inclement weather. The lens 7 may also assist in the diffusion of light and increase the uniformity of light over the surface of the recessed lighting system 1. The lens 7 may be made of any at least partially transparent material, including glass and hard plastics. In one embodiment, the lens 7 and the reflector 6 are contained in a single indivisible unit to work in conjunction to focus and adjust light emitted by the light source module 3. In other embodiments, the lens 7 and the reflector 6 are separate, divisible elements as shown in FIG. 1.

In one embodiment, the recessed lighting system 1 may include a trim 8. The trim 8 serves the primary purpose of covering the exposed edge of the ceiling or wall where a hole is formed in which the recessed lighting system 1 resides while still allowing light from the light source module 3 to be emitted into a room through an aperture 22. In doing so, the trim 8 helps the recessed lighting system 1 appear seamlessly integrated into the ceiling or wall. In one embodiment, the trim 8 is capable of coupling to the casting 5 while in other embodiments the trim 8 is capable of coupling to the junction box 2. The trim 8 may couple to the casting 5 and/or the junction box 2 using any connecting mechanism, including resins, clips, screws, bolts, or clamps. In one embodiment, the trim 8 may include grooves and/or slots to couple to corresponding grooves and/or slots of the casting 5 and/or the junction box 2 using a twist-and-lock friction connection and without the use of separate tools or other devices.

In one embodiment, different diameter trims 8 may be capable of being coupled to the casting 5 and/or the junction box 2. The size and design of the trims 8 may depend on the size of the hole in which the recessed lighting system 1 has been fitted and that the trim 8 must conceal, as well as the aesthetic decisions of the consumer. The trims 8 may be made of aluminum plastic polymers, alloys, copper, copper-tungsten pseudoalloy, AlSiC (silicon carbide in aluminum matrix), Dymalloy (diamond in copper-silver alloy matrix), and E-Material (beryllium oxide in beryllium matrix).

As seen in FIG. 1 the casting or housing 5 also includes a side wall 5*a* which in the figure is seen to be generally cylindrical and terminates in a front end face 15 which encompasses a front aperture 15*a*. The side wall 5*a* is continuous with the rear wall 14 and with heat sink fins 18 formed integrally with the side and rear walls of the unitary casting.

As shown in FIG. 1 and in FIG. 2, a trim 8 is assembled and retained to housing 5 by interlocking with twist-and-lock flanges 11A, 11B formed integrally with housing 5. The two twist and lock flanges 11A, 11B are better seen in FIG. 1 to extend radially from diametrically opposite sides of the front end face 15 integrally with side wall 5*a* of housing 5, and the forward surfaces of the locking flanges 11A, 11B are seen to be flush with the front end face 15.

As best seen in FIG. 3 flanges 11A, 11B also are substantially coplanar with the lens 7 as well as coplanar with a first circular rabbet recess 29A defined along an inner edge of front end face 15 and containing the lens 7. Consequently, with the lens installed in the rabbet, the front or exterior surface of lens 7 and forward surfaces of the flanges 11A, 11B define a nearly planar front surface for the compact light.

The unitary structure of the housing 5 and the coplanar location of the trim interlocking flanges 11A, 11B allow a reduction in total height of the compact light as measured between lens 7 and rear wall 14. Such reduced height in turn facilitates installation of the light in a standard but relatively small junction box which already has received a sufficient fire rating, so that the compact light can be installed in a ceiling directly in a j-box without use of a "can", as has been explained previously herein, thus greatly simplifying installation of the compact light.

The rabbet may be a two step rabbet, as seen in FIGS. 1 and 3, such that the lens 7 is held in the larger diameter outer rabbet 29A and a rim 6*a* of reflector 6 is held in the smaller diameter inner rabbet 29B.

The invention claimed is:

1. A recessed light system, comprising:

a compact lighting assembly, comprising:

a light source module including at least one LED;

electrical wires to receive AC voltage from an electrical system of a buiding;

an AC to DC converter to receive electrical energy from the electrical wires and supply regulated electrical energy to power the light source module;

a lens;

a reflector; and a heat-sinking housing having a rear portion above which a cavity is formed, a front position that surrounds a aperture, and a sidewall, wherein:

a first end of the sidewall is joined to the rear portion and a second end of the sidewall is joined to the front portion;

the sidewall extends around the central axis of the heat-sinking housing;

the rear portion and the sidewall are formed of a heat conductive material capable of dissipating heat generated by the light source module away from the light source module;

the heat-sinking housing further comprises a twist-and-lock mechanism comprising flanges that extend outward from the front portion of the heat-sinking housing, wherein a maximum ouside width of the flanges is greater than 3 ½ inches;

the distance along the sidewall, between the flanges and an outside surface of the rear portion, is less than 1 ½ inches;

a maximum width of the sidewall, between the flanges and the rear portion, is less than 3 ½ inches; and the light source module is positioned inside the cavity closer to an inside surface of the rear portion than to an exterior surface of the front portion of the heat-sinking housing;

wherein:

at least a portion of a front surface of the lens is coplanar with the exterior surface of the front portion of the heat-sinking housing to direct light produced by the light source module through the aperture into an area surrounding the recessed lighting system;

the reflector is positioned inside the heat-sinking housing to direct light emitted from the light source module through the lens;

the electrical wires pass through the rear portion of the heat-sinking casting; and the AC to DC converter is positioned between the rear portion of the heat-sinking housing and the reflector.

2. The recessed lighting system of claim 1, wherein the heat-sinking housing is capable of dissipating heat away from the light source module during operation so that the light source module operates within its operating parameters without requiring connection to another heat sink structure, and wherein the heat-sinking housing comprises one of a cylindrical, ellipsoid, conical, or polygonal shape.

3. The recessed lighting, system of claim 1, further comprising an enclosure to contain at least a portion of the heat-sinking housing of the compact lighting assembly, wherein the enclosure comprises one of a junction box, a standard junction box and a 4-10 inch recessed lighting fixture.

4. The recessed lighting system of claim 3, wherein:

the enclosure comprises the standard junction box; and the front portion of the heat-sinking casting further comprises holes that align with tabs of the standard junction box to facilitate installation of the compact lighting assembly in the standard junction box, wherein the lens of the compact lighting assembly does not preclude access to the holes.

5. The recessed lighting system of claim 3, further comprising a trim coupled to the twist-and-lock mechanism of the heat sinking housing, wherein:

a trim size of the trim is based on a hole size of a hole in which the recessed lighting system has been fitted;

the front portion of the heat-sinking housing does not extend beyond an exposed edge of the hole in which the recessed lighting system has been fitted; and the trim comprises at least one of an aluminum plastic polymer, an alloy, copper, copper-tungsten pseudoalloy, AlSiC (silicon carbide in aluminum matrix), diamond in copper-silver alloy matrix, and beryllium oxide in beryllium matrix.

6. The recessed lighting system of claim 1, wherein the heat sinking housing further comprises openings in the flanges to align with tabs of a standard-sized junction box, and wherein the heat sinking housing is a single-piece metal casting.

7. A recessed lighting system, comprising:

a single junction box including holes for receiving screws or bolts;

a heat-sinking casting disposed in the single junction box, the heat-sinking casting including a casting cavity and a front end face comprising;

corresponding holes that align with the holes of the single junction box to facilitate installation of the heat-sinking casting in the single junction box with the screws or the bolts; and flanges providing at least one twist-and-lock friction connection to the front end face of the heat-sinking casting;

a light source module disposed in the casting cavity;

a lens positioned such that at least a portion of a front surface of the lens is coplanar with the front end face of the heat-sinking casting;

a driver, disposed in the single junction box to power the light source module, the driver including an electronic device to at least one of supply and regulate electrical energy to the light source module; and a trim to cover an exposed edge of a hole in a ceiling or a wall into which the recessed lighting system is installed, wherein the trim includes at least one connecting mechanism to couple the trim to at least one of the single junction box and the flanges providing the at least one twist-and-lock friction connection to the front end face of the heat-sinking casting.

8. The recessed lighting system of claim 7, further comprising a pair of complimentary, keyed or interlocking connectors to make an electrical connection to at least one of the light source module and the driver.

9. The recessed lighting system of claim 8, further comprising wires to supply electrical power to the light source module, wherein the wires passes pass through a rear surface of the casting, and the wires are coupled to at least one keyed or interlocking connector of the pair of complimentary keyed or interlocking connectors.

10. The recessed lighting system of claim 7, wherein the at least one connecting mechanism of the trim comprises at least one of a twist-anti-lock friction connector, one or more springs, one or more clips, one or more clamps, and one or more screws.

11. The recessed lighting system of claim 7, further comprising:

at least one optic element disposed inside the heat-sinking casting to direct light produced by the light source module into an area surrounding the recessed lighting system, wherein the at least one optic element does not preclude access to the corresponding holes in the front end face of the casting when the at least one optic element is positioned inside the cavity of the casting.

12. The recessed lighting system of claim 11, further comprising:

a pair of complimentary keyed or interlocking connectors to make an electrical connection to at least one of the light source module and the driver; and wires to supply electrical power to the light source module, wherein the wires pass through a rear surface of the casting, and the wires are coupled to at least one keyed or interlocking connector of the pair of complimentary keyed or interlocking connectors, wherein;

at least one flange of the flanges includes at least one corresponding, hole of the corresponding holes; and the at least one connecting mechanism of the trim comprises at least one of a twist-and-lock friction connector, one or more springs, one or more clips, one or more clamps, and one or more screws.

13. A recessed lighting system, comprising:

a junction box;

a heat-sinking casting installed in the junction box and having a closed rear face, a cylindrical sidewall, and an open front face forming a cavity;

a light source module positioned inside the cavity such that the light source module is closer to the closed rear face of the heat-sinking casting than the open front face of the heat-sinking casting;

an AC to DC converter to power the light source module and positioned inside the cavity;

a lens; and a reflector positioned inside the cavity of the casting to direct light produced by the light source module out of the open front face and into an area surrounding the recessed lighting system while shielding the driver from exposure to the area surrounding the recessed lighting system, wherein the reflector surrounds the light source module, wherein;

the heat-sinking casting includes a front end face to encompass the open front face;

the from end face of the heat-sinking casting includes a first circular rabbet recess defined along an inner edge of the front end face, wherein the lens is disposed in the first circular rabbet recess; and the recessed lighting system further comprises at least one connecting mechanism couple a trim to the front end face of the casting.

14. The recessed lighting system of claim 13, further comprising a trim.

15. The recessed lighting system of claim 13, wherein the at least one connecting mechanism comprises at least one tool-less connecting mechanism.

16. The recessed lighting system of claim 13, wherein the at least one connecting mechanism comprises at least one of a resin, one or more clips, one or more springs, one or more bolts, one or more screws, and one or more clamps.

17. The recessed lighting system of claim 13, wherein the at least one connecting mechanism comprises at least one of at least one groove and at least one slot.

18. The recessed lighting system of claim 13, wherein the at least one connecting mechanism comprises at least one twist-and-lock friction connector including flanges extending from the front end face and having respective forward surfaces that are flush with the front end face and substantially coplanar with an exterior surface of the lens disposed in the first circular rabbet recess defined along the inner edge of the front end face.

19. The recessed lighting system of claim 18, further comprising a trim.

* * * * *